United States Patent [19]

Leiter et al.

[11] 4,280,030

[45] Jul. 21, 1981

[54] HIGH CURRENT MECHANISM HAVING FLEXIBLE CONTACT ARM

[75] Inventors: Gordon A. Leiter, Rome, Ga.; Herman H. Schall, Hudson, Ohio

[73] Assignee: General Electric Company

[21] Appl. No.: 785,500

[22] Filed: Apr. 7, 1977

[51] Int. Cl.[3] ..... H01H 21/54

[52] U.S. Cl. ..... 200/237; 200/269; 200/155R; 339/245

[58] Field of Search ..... 200/155 R, 162, 163, 200/48 P, 237, 238, 245, 246, 268, 269, 270, 273, 274, 275; 339/245, 255 R, 272 R

[56] References Cited

U.S. PATENT DOCUMENTS

| | | | |
|---|---|---|---|
| 1,831,843 | 11/1931 | Cornfield | 200/278 |
| 2,786,922 | 3/1957 | Stumpfhaus | 200/278 |
| 2,944,099 | 7/1960 | Sernitz et al. | 339/245 |
| 3,194,934 | 7/1965 | Gauthier | 200/245 |
| 3,364,324 | 1/1968 | Pasi | 200/278 |
| 3,746,819 | 7/1973 | Linde | 200/162 |
| 4,002,870 | 1/1977 | Phillips | 200/278 |

*Primary Examiner*—Herbert F. Ross
*Attorney, Agent, or Firm*—R. A. Menelly

[57] ABSTRACT

A flexible high current carrying connection between relatively fixed and moveable terminals is provided by constructing the connection of electrically conductive laminated material and forming at least a portion of said connection into an S-shape. With this type of connection a flexible, low cost, high current-carrying connecting link permitting a limited degree of rotation between relatively fixed and moveable points is provided that requires a minimum amount of space to accommodate such a connecting link.

5 Claims, 4 Drawing Figures

HIGH CURRENT MECHANISM HAVING FLEXIBLE CONTACT ARM

BACKGROUND OF THE INVENTION

The present invention relates to high current carrying mechanisms in general and to high current carrying flexible connections in such mechanisms, in particular.

Equipment for controlling electric power to or from other electrical equipment, such as a load tap changer for an electrical power transformer, will often include mechanisms that require high currents to flow between relatively fixed and moveable electrical terminals or points, in such mechanisms. The relative motion between fixed and moveable points includes many different types, and the extent to which these points move with respect to one another varies considerably.

In mechanisms where a moveable point rotates less than a complete revolution about an axis that is parallel to or coincident with an axis through a fixed point, torsional forces, that might be created in the electrical connection between such fixed and moveable points, are an important design consideration.

In addition to this torsional force problem, some of these mechanisms have several hundred amperes flowing between such fixed and moveable electrical terminals making it absolutely essential that the electrical resistance of the connection between these points be as low as possible for minimum power dissipation in such a connection.

In one prior art arrangement the electrical connection between a fixed and a moveable point in an electric power controlling mechanism consists of a pivotable elongated arm of rectangular cross section having a curved flange extending from one side with a pair of fingers that are spring biased to and are in sliding contact with said laterally extending curved flange. This sliding contact arrangement introduces a relatively low amount of electrical resistance between fixed and moveable points and essentially avoids the torque problem mentioned above for electrical connections between relatively fixed and moveable points. While this sliding contact type of electrical connection is a satisfactory one in terms of its electrical characteristics, it is a relatively complex device, being relatively difficult and costly to fabricate.

In another such mechanism for controlling power to or from other electrical equipment, a connection between fixed and moveable electrical terminals or points consists of a length of braided strands of electrically conductive material such as copper, aluminum or the like. This type of connection has a very low electrical resistance and, in addition, essentially avoids the torque problem between relatively fixed and moveable terminals that was mentioned above. A major problem with an electrical connection of this type is the requirement that its cross section be relatively large in order to handle the large currents that must pass through such a connection. Equipments that might utilize a connection of this type do not normally have the space that would be required to properly house this type of connection.

Problems such as those associated with the electrical connections of the type described above can be avoided by utilizing an embodiment of the electrical connection of the present invention.

SUMMARY OF THE INVENTION

In accordance with the present invention, a flexible, compact, high current carrying electrical connection between relatively fixed and moveable terminals in a mechanism for controlling electric power to and/or from electrical equipment, is disclosed. The compactness and high current carrying capability of this connection are achieved by utilizing a plurality of adjacent, electrically conductive, rectangular plates that are joined to one another at least at the point where they are connected to said fixed and moveable terminals. Connection rotational flexibility is achieved by forming at least a portion of same into the shape of the letter S.

DESCRIPTION OF THE PRIOR ART

Figure 1:
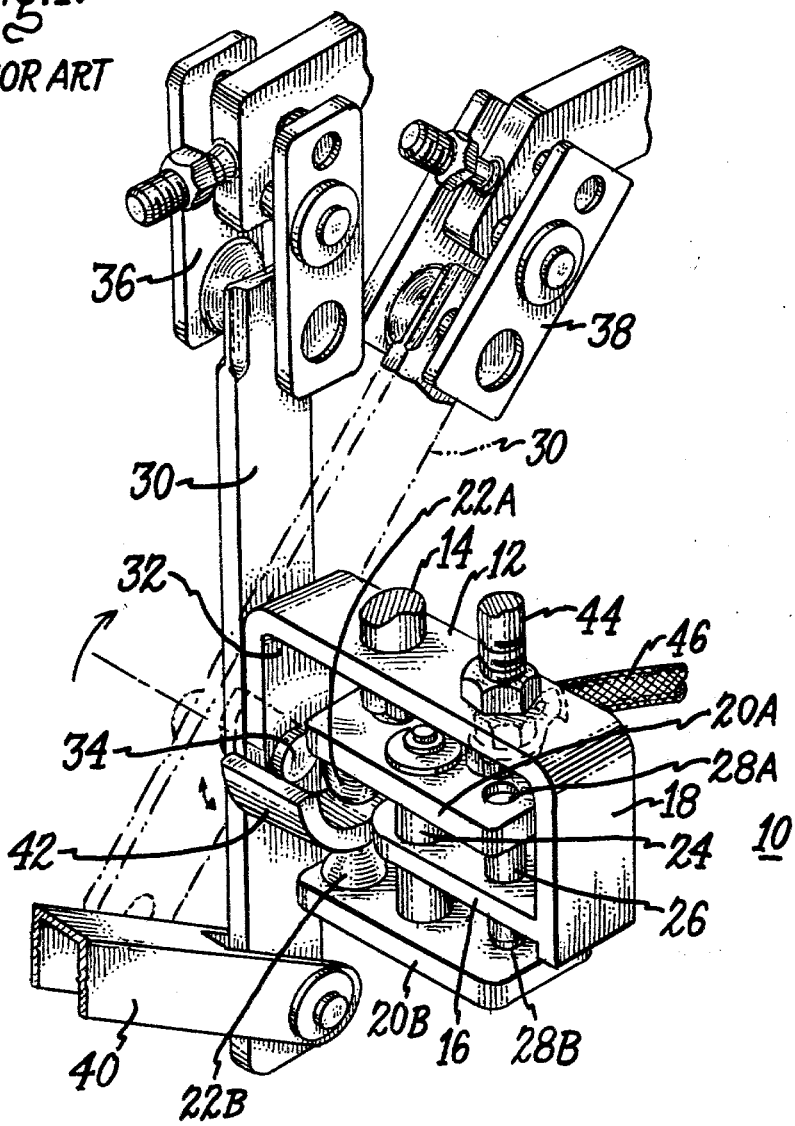
Fig. 1. PRIOR ART
FIG. 1 is a perspective view depicting two switch positions of a high current carrying mechanism that is constructed in accordance with the teachings of the prior art.

Referring now to the drawings and specifically to FIG. 1 wherein a perspective view of a high current carrying mechanism, constructed in accordance with the prior art, is depicted.

High current carrying mechanism 10 includes U-shaped electrically conductive bracket 12 which is held in a fixed position by mounting stud 14 and terminal 44 which are, in turn, attached, in a fixed position, to mechanism support structure (not shown). Plate 16, which forms a part of leg 18 of U-shaped bracket 12, extends laterally from said leg 18 and inwardly of said U-shaped bracket 12, it being generally perpendicular to said leg 18. A pair of plate-like fingers 20A and 20B, each having ball-type ends 22A and 22B respectively, are spring-biased toward one another and are attached to plate 16 by spring assembly 24. The nonball-type ends of fingers 20A and 20B are maintained in electrical and moveable contact with plate 16 of bracket 12 by said spring assembly 24, through pin 26. Pin 26 is of generally cylindrical shape and has ends that are of smaller diameter cross section than its central portion. Pin 26 passes through and is brazed to plate 16 at the central portion of said pin 26. The smaller diameter ends of pin 26 are inserted into circular opening 23A and 28B in the nonball-type ends of fingers 20A and 20B, respectively. The smaller diameter ends of pin 26 are rounded for improved moveable contact with fingers 20A and 20B and the force exerted by spring assembly 24 maintains the electrical connection of this moveable contact. The primary conductive path between plate 16 and fingers 20A and 20B is through pin 26.

Electrically conductive blade 30 is rotatably attached to leg 32 of bracket 12 by pin 34. Blade 30 is rotated between stationary electrically conductive contacts 36 and 38, about an axis through pin 34 by blade actuating rod 40, under no-load conditions. Semicircular flange 42 is an integral part of and extends laterally from blade 30. Flange 42 slides between and is in electrical contact with ball-type ends 22A and 22B, of fingers 20A and 20B, respectively, as blade 30 is rotated about an axis through pin 34 by blade actuating rod 40. The angular rotation of blade 30 about an axis through pin 34 is approximately 45 degrees.

Current enters terminal 44 from electrical conductor 46 and passes through leg 18 and plate 16 of U-shape bracket 12. From plate 16 current passes through pin 26, into fingers 20A and 20B and through the ball-type ends 22A and 22B respectively, of said fingers 20A and 20B, and then into semicircular flange 42 which forms a part of blade 30. Current then passes through blade 30 and into either stationary contacts 36 or 38, depending upon the position of said blade 30 as determined by blade actuating rod 40.

DESCRIPTION OF THE PREFERRED EMBODIMENT

Figure 2:
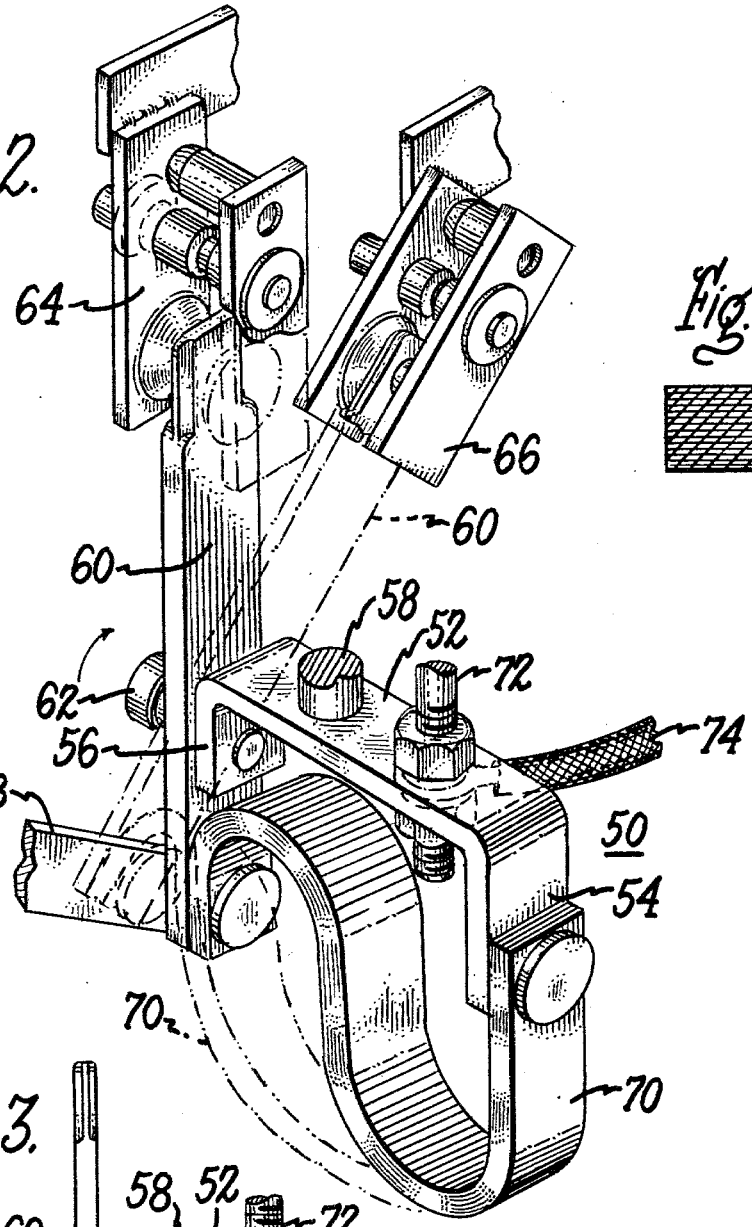
FIG. 2 is a perspective view depicting two switch positions of a high current carrying mechanism that incorporates a flexible connection between relatively fixed and moveable terminals that embodies the inventive concept of the present invention.
Figure 4:
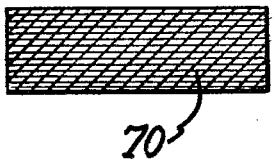
FIG. 4 is an enlarged detail of the sectional view taken on the line 4—4 in FIG. 3.

Turning now to the present invention and specifically to FIG. 2 which is perspective view of a high current carrying mechanism incorporating a flexible connection that is constructed in accordance with a preferred embodiment of the present invention.

High current carrying mechanism 50, in FIG. 2, includes U-shaped electrically conductive bracket 52, having legs 54 and 56, that is held in a fixed position by mounting stud 58 and terminal 72 which, in turn, are attached in a fixed position to mechanism support structure (not shown). Electrically conductive blade 60 is rotatably attached to leg 56 of U-shaped bracket 52 by pin 62. Blade 60 is rotated between stationary, electrically conductive contacts 64 and 66, about an axis through pin 62 by blade actuating rod 68, under no load conditions. Flexible electrical conductor 70, of rectangular cross section, is brazed to both leg 54 of U-shaped bracket 52 at one end, and to blade 60 at the other end of said flexible conductor 70. The shape of flexible conductor 70 and its placement with respect to leg 54 of bracket 50 and blade 60, can be more clearly understood by referring to FIG. 3.

Figure 3:
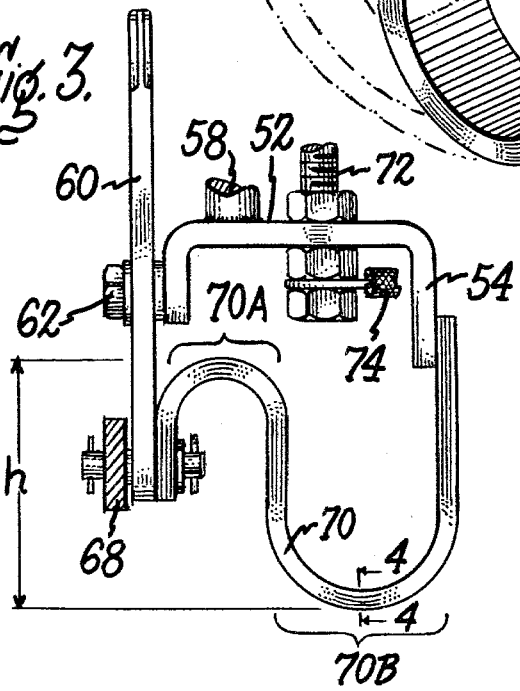
FIG. 3 is a front elevational view of the high current carrying mechanism depicted in FIG. 2 showing the S-shape curve of the flexible connection of the present invention in greater detail.

Flexible connection 70 in FIG. 3 is fabricated of a plurality of lamina or adjacent electrically conductive plates that are physically attached to one another at least at the point where said flexible connection 70 is attached to leg 54 and blade 60, and is formed into the shape of the letter "S". As stated above, the ends of flexible connection 70 are brazed to said leg 54 and blade 60.

Current enters terminal 72 from electrical conductor 74 and then enters bracket 52 to which said terminal is structurally and electrically connected. After entering bracket 52 current passes through leg 54 of said bracket 52, through S-shaped flexible connection 70 and into blade 60. Current then passes through blade 60 and will enter either contact 64 (FIG. 2) or contact 66 (FIG. 2), depending upon the rotational position of said blade 60.

As indicated above, flexible connection 70 is of laminated construction, it being constructed of a plurality of electrically conductive adjacent lamina. An enlarged cross sectional view taken on the line 4—4 in FIG. 3 shows the placement of these laminations with respect to one another. While other lamination thicknesses can be utilized in flexible connection 70, it has been determined that the optimum thickness of each lamina, for the current that must be handled by such a connection in this the preferred embodiment is approximately ten thousandths of an inch.

DISCUSSION

The flexible connection described in the preferred embodiment of the present invention combines current carrying capability with compactness and torque compensation. These qualities were obtained in the prior art by a complex mechanism that is relatively costly to construct. In prior art mechanisms, torque forces between relatively fixed and moveable points are essentially avoided, by providing a sliding electrical contact between these points. High current carrying capability and compactness are achieved by utilizing a pair of finger-like members which are maintained in sliding, low resistance, electrical contact with a moveable member by a force generating spring assembly.

By contrast, the present invention utilizes a plurality of adjacent, electrically conductive plates or lamina that are connected between relatively fixed and moveable points, of the type mentioned above, and are brazed or otherwise attached to these points. This arrangement provides an electrical connection that permits an adequate but limited degree of rotational movement between such fixed and moveable points that avoids the necessity for a relatively complex and costly mechanism such as the prior art mechanism depicted and described above. In addition, the present electrical connection provides a low resistance, high current carrying path for use in a mechanism where there is a limited amount of space.

The "S" shape of connection 70 (FIG. 3) allows flexing to take place in regions 70A and 70B of said connection 70. As connection 70 is pivoted about the leg 54 attachment point, the required extension of one side and compression of the other side of curved portion 70B of connection 70 is compensated for by a corresponding compression and extension of the sides of the curved portion 70A of said connection 70. This arrangement eliminates the bending that occurs at both sides of the curved portion of a single U-shaped connection. This arrangement greatly reduces the torque required to complete the pivot motion of and the stresses on, connection 70. Constructing connection 70 of a plurality of laminations permits relative motion between these laminations. This further reduces torques and stresses on connection 70 thus reducing susceptibility to metal-fatique over that of a non-laminated connection having an equivalent cross section area. The S-shape and laminated construction combine to give connection 70 the desired degree of flexibility that is within the elastic limit of the material from which such a connection is constructed. The cross sectional area of the flexible connection is primarily determined by the current that it will be required to handle.

Connection 70 is normally fabricated from relatively thin copper plate material; however, this concept may also be utilized for electrical connections that are fabricated from other metals such as aluminum or metal alloys.

Electrical connection 70 is attached at its ends by brazing same as previously indicated. Though less desirable, the ends of connection 70 may also be attached by nuts and bolts, rivets or other such fastening means.

It will be apparent to those skilled in the art from the foregoing description of the present invention that various improvements and modifications can be made in it without departing from its true scope. Accordingly, it is our intention to encompass within the scope of the appended claims the true limits and spirit of our invention.

We claim:

1. In a high current carrying mechanism of the type that includes at least one high current carrying, electrically conductive flexible connection between first and second points, said second point being rotatable through less than half a revolution, about an axis that is generally parallel to or coincident with an axis through said first point, the improvement comprising:

that said high current carrying, electrically conductive flexible connection between said first and second points is fabricated of electrically conductive, laminated material, with individual laminae being electrically connected to adjacent laminae, at least in the region where said laminated, electrically conductive flexible connection is attached to said first and second points; and said laminated, electrically conductive flexible connection includes at least a portion that is of S-shape.

2. A flexible connection for a high current carrying mechanism, as defined in claim 1, wherein said S-shape extends from said first point to said second point.

3. A flexible connection for a high current carrying mechanism as defined in claim 1, wherein the laminations of said flexible connection are of copper construction.

4. A flexible connection for a high current carrying mechanism as defined in claim 1, wherein the thickness of each lamination in said flexible connection is ten thousandths of an inch.

5. A flexible connection for a high current carrying mechanism as defined in claim 1, wherein said flexible connection is connected between said first and second points by brazing.

* * * * *